US011149405B2

(12) United States Patent
Hogan et al.

(10) Patent No.: US 11,149,405 B2
(45) Date of Patent: Oct. 19, 2021

(54) GRADE CONTROL INDICATOR ASSEMBLY

(71) Applicants: Caterpillar Paving Products Inc., Brooklyn Park, MN (US); Caterpillar Trimble Control Technologies LLC, Dayton, OH (US)

(72) Inventors: Lee Hogan, Champlin, MN (US); Mathew Hedrington, Ham Lake, MN (US); Toby Frelich, Saint Michael, MN (US); Andrew Kopca, Andover, MN (US); Mark Tarvin, Canton, IL (US); Ryan Thiesse, Otsego, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 245 days.

(21) Appl. No.: 16/399,335

(22) Filed: Apr. 30, 2019

(65) Prior Publication Data

US 2020/0347571 A1 Nov. 5, 2020

(51) Int. Cl.
*E02F 3/84* (2006.01)
*H01H 13/02* (2006.01)

(52) U.S. Cl.
CPC ..... *E02F 3/844* (2013.01); *H01H 13/023* (2013.01)

(58) Field of Classification Search
CPC .. H01H 13/023; E02F 3/00; E02F 3/04; E02F 3/16; E02F 3/65; E02F 3/76; E02F 3/80; E02F 3/815; E02F 3/84; E02F 3/841; E02F 3/844; E02F 3/845; E02F 3/847; E02F 3/848; E02F 3/7636; E02F 9/00; E02F 9/26; E02F 9/08; E02F 9/2004; E02F 9/2041; E02F 9/085; E02F 1/00; E02F 5/00; G05D 3/00; G05D 3/12; G05D 2201/00; G05D 2201/02; G05D 2201/0201; G05D 1/00; G05D 1/0044; G05D 1/005; G05D 1/02; G05D 1/021; G05D 1/027; G01C 21/203; G01C 21/3415; G01C 21/3423; G01C 21/3614; G01C 21/3664; G01C 3/0488; G01C 21/005
USPC ..... 701/50
See application file for complete search history.

(56) References Cited

U.S. PATENT DOCUMENTS

| | | | | |
|---|---|---|---|---|
| 7,246,456 | B2 * | 7/2007 | Wray | A01B 69/008 172/4 |
| 7,350,932 | B2 * | 4/2008 | Lin | H01H 13/83 200/314 |
| 7,857,071 | B1 * | 12/2010 | McCain | E02F 3/847 172/4.5 |
| 8,104,566 | B2 * | 1/2012 | Harber | B60N 2/753 180/315 |
| 2008/0055490 | A1 * | 3/2008 | Yasuda | G09G 5/393 348/739 |
| 2012/0256843 | A1 * | 10/2012 | Epple | A01D 41/127 345/169 |

(Continued)

*Primary Examiner* — Anthony R Jimenez
(74) *Attorney, Agent, or Firm* — Harrity & Harrity LLP

(57) ABSTRACT

A grade control indicator assembly is disclosed. The grade control indicator assembly may include a keypad to control one or more functionalities of a machine, where the keypad includes a set of grade control light indicators integrated into the keypad, and where the set of grade control light indicators includes a first subset of grade control light indicators for indicating a grade of the machine with respect to a first side of the machine and a second subset of grade control light indicators for indicating the grade of the machine with respect to a second side of the machine.

20 Claims, 4 Drawing Sheets

(56) References Cited

U.S. PATENT DOCUMENTS

2015/0103287 A1* 4/2015 Saitou ..... E02F 9/0858
349/58

* cited by examiner

104

GRADE CONTROL INDICATOR ASSEMBLY

TECHNICAL FIELD

The present disclosure relates generally to an indicator assembly and, more particularly, to a grade control indicator assembly that includes a keypad with a set of grade control light indicators integrated into the keypad and raised above a surface of a frame into which the grade control indicator assembly is to be disposed.

BACKGROUND

A machine, such as a grading machine, motor grader machine, a paver, a cold planer, a rotary mixer, and/or the like, may include a transmission coupled to a power source, such as an internal combustion engine to enable the machine to be repositioned and/or to travel between locations. During a grading operation the machine may be used to achieve a desired grade for a surface. An operator of the machine may determine a current grade of the machine and may adjust one or more control parameters of the machine to cause the machine to change from the current grade to the desired grade. The machine may include a grade control console that provides a display to provide information regarding the current grade of the machine. The display may include an integrated grade control light bar to provide an indication of the current grade of the machine.

However, previous attempts to integrate a grade control light bar into a display of a grade control console have resulted in difficulties with regard to servicing the grade control light bar. For example, the display may include many electrical components, which may make isolating an issue with an electrical component of the grade control light bar difficult. Further, the grade control light bar may be associated with a poor angle of view for the operator as a result of the display blocking the operators view when the operator attempts to view the grade control light bar from an angled position. This may negatively affect an operability of the machine, which may result in poor grade control.

The grade control indicator assembly of the present disclosure solves one or more of the problems set forth above and/or other problems in the art.

SUMMARY

A grade control indicator assembly may include a keypad to control one or more functionalities of a machine, the keypad including a set of grade control light indicators integrated into the keypad, and the set of grade control light indicators including a first subset of grade control light indicators for indicating a grade of the machine with respect to a first side of the machine and a second subset of grade control light indicators for indicating the grade of the machine with respect to a second side of the machine.

A grade control system may include a display device and a grade control indicator assembly. The grade control indicator assembly may include a first sub-assembly disposed on a first side of the display device and associated with indicating a grade of a machine with respect to a corresponding first side of the machine and a second sub-assembly disposed on a second side of the display device and associated with indicating the grade of the machine with respect to a corresponding second side of the machine. Each sub-assembly may include a plurality of grade control light indicators raised above a frame of the grade control indicator assembly.

A grade control indicator assembly may include a keypad to control one or more functionalities of a machine, the keypad including a set of grade control light indicators integrated into the keypad and raised above a surface of the keypad to provide greater than a threshold viewing angle, and the set of grade control light indicators including a first subset of grade control light indicators for indicating a grade of the machine with respect to a first side of the machine and a second subset of grade control light indicators for indicating the grade of the machine with respect to a second side of the machine.

DETAILED DESCRIPTION

Figure 1:
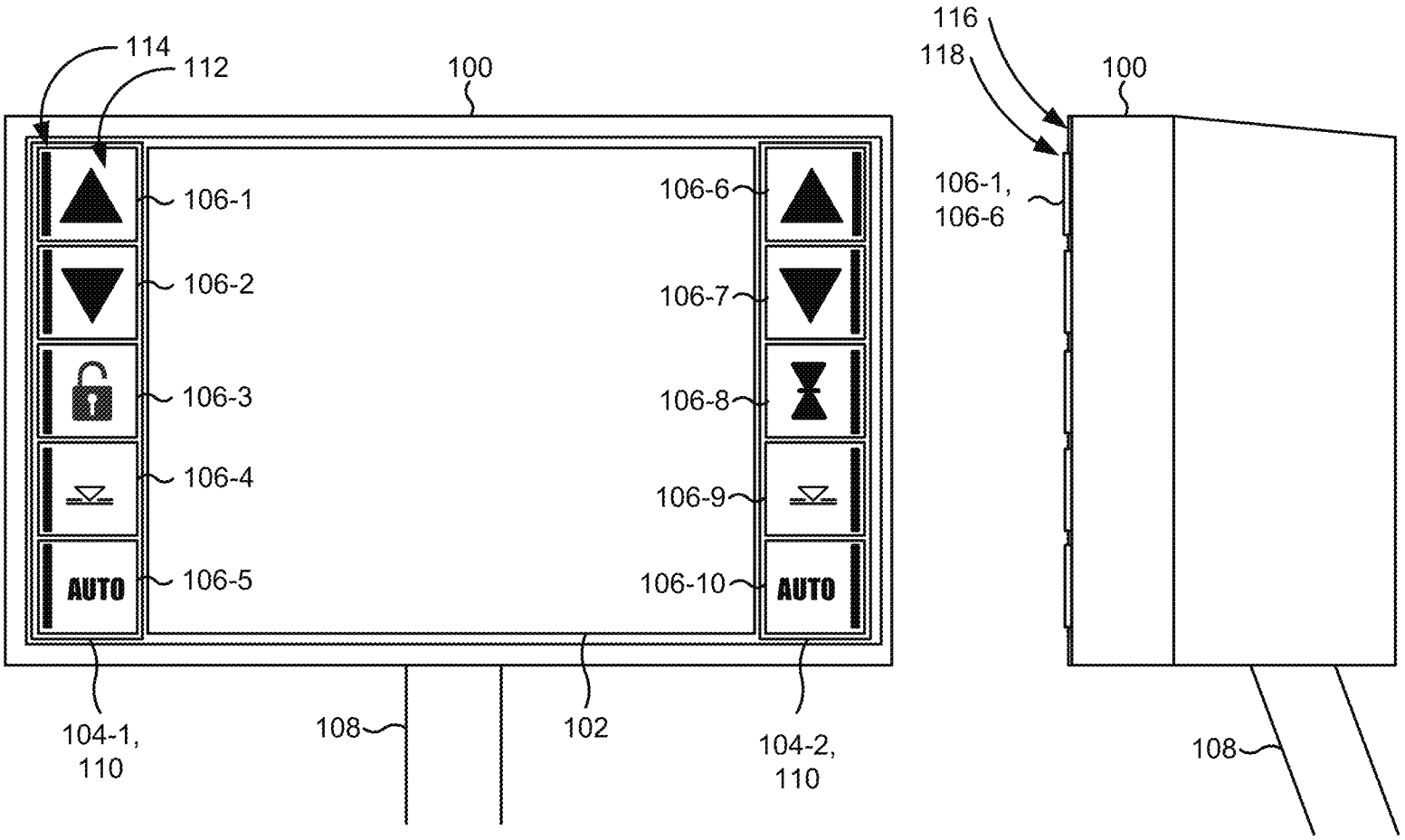
FIG. 1 is a diagram of an example grade control system.

FIG. 1 is a diagram of an example grade control system 100. The grade control system 100 is shown in a front view and a side view.

As shown in FIG. 1, the grade control system 100 may include a display 102 and a set of grade control indicator subassemblies 104, shown as grade control indicator subassemblies 104-1 and 104-2. Each grade control indicator subassembly 104 may include a set of grade control light indicators 106, shown as grade control light indicators 106-1 through 106-10.

The grade control system 100 may be an apparatus that is operably connected to operator controls of a machine, such as a motor grader machine, a paver machine, a screed machine, a cold planer machine, and/or the like. The grade control system 100 may be supported in an operator station of a machine by a support 108. The support 108 may provide structural support for mounting the grade control system 100 in the operator station of the machine and/or may communicatively connect the grade control system 100 to the operator controls of the machine, to one or more implements of the machine (e.g., a grader implement), and/or the like. In some implementations, the grade control system 100 may be decoupled from other operator controls of the machine. For example, the grade control system 100 may be a separate console connected to the machine, rather than integrated into other control systems of the machine.

The display 102 may be a display that provides a user interface including information relating to a state of a machine. For example, the display 102 may provide, for display, a user interface identifying a grade of the machine, whether the machine is moving, and/or the like. In some implementations, the display 102 may provide information relating to the grade control light indicators 106. For example, the display 102 may provide information identifying a function of each grade control light indicator 106, help information for enabling an operator to use each grade control light indicator 106 to operate a corresponding function, and/or the like.

The grade control indicator subassemblies 104 may form a grade control indicator assembly 110. Each grade control indicator subassembly 104 may be associated with providing grade control information for a machine. For example, the grade control indicator subassembly 104-1 may provide grade control information for a first side of a machine and the grade control indicator subassembly 104-2 may provide grade control information for a second side of the machine. The grade control indicators subassemblies 104 may be detachable from display 102. For example, the grade control system 100 may include a frame to receive the grade control indicator subassemblies 104 and the display 102.

Each grade control indicator subassembly 104 may include multiple grade control light indicators 106. For example, the grade control indicator subassembly 104-1 includes grade control light indicators 106-1 through 106-5 and the grade control indicator subassembly 104-2 includes grade control light indicators 106-6 through 106-10. Although some implementations are shown with a particular quantity of grade control indicator subassemblies 104 and/or a particular quantity of grade control light indicators 106, other configurations with other quantities are possible. The grade control light indicators 106 may be backlit indicators. Alternatively, the grade control light indicators 106 may each be a display button coupled to a display controller that controls information provided for display on each display button.

The grade control light indicators 106 may be a set of keys of a keypad that include light indicators. For example, grade control light indicator 106-1 may be a keypad key that includes a function indicator 112 corresponding to a function of grade control light indicator 106-1 and a grade indicator 114 to identify a grade of a machine. Each grade control light indicator 106 may include a grade indicator 114 to indicate a level of the grade (e.g., forming 5 grade levels for each side of a machine, which may correspond to a two positive-slope grades, a neutral-slope grade, and two negative-slope grades). In some implementations, the grade control light indicators 106 may be associated with control of a grade or a slope of a machine.

As an example, the grade control light indicator 106-1 may be associated with an 'increase grade for a left side of the machine' function. Similarly, the grade control light indicator 106-2 may be associated with a 'decrease grade for the left side of the machine' function, the grade control light indicator 106-3 may be associated with a 'lock display' function (e.g., a locking functionality to lock a user interface of display 102), the grade control light indicator 106-4 may be associated with a 'store grade for the left side of the machine' function (e.g., a memory functionality), and the grade control light indicator 106-5 may be associated with an 'activate/deactivate automatic grade control for the left side of the machine' function (e.g., an automatic grade control functionality).

As another example, the grade control light indicator 106-6 may be associated with an 'increase grade for a right side of the machine' function, the grade control light indicator 106-7 may be associated with a 'decrease grade for the right side of the machine' function, the grade control light indicator 106-8 may be associated with a 'access grade control on display' function (e.g., change a user interface of display 102 to show information relating to grade control), the grade control light indicator 106-9 may be associated with a 'store grade for the right side of the machine' function, and the grade control light indicator 106-10 may be associated with an 'activate/deactivate automatic grade control for the right side of the machine' function. Although described herein in terms of a particular set of functionalities, other functionalities may be used in various implementations.

As further shown in FIG. 1, a surface 116 of each grade control light indicator 106 may extend above a surface of a frame 118 of grade control system 100. For example, the surface of each grade control light indicator 106 may be raised above the frame. In this case, the grade control light indicators 106 may project above a surface of, for example, display 102, a frame of grade control system 100, and/or the like. In this way, each grade control light indicator 106 may be associated with greater than a threshold viewing angle. For example, relative to a normal angle (e.g., an operator viewing the grade control system 100 straight-on), grade control light indicators 106 may be associated with viewing angles of greater than 15 degrees, 30 degrees, 45 degrees, 60 degrees, 75 degrees, 85 degrees, 89 degrees and/or the like, thereby enabling an operator to use grade control system 100 without needing to position grade control system 100 directly in front of the operator. In some implementations, grade control light indicators 106 may be associated with a total viewing angle of 180 degrees (e.g., 90 degrees from a normal plane perpendicular to a surface of a grade control light indicator 106, in each direction). In this way, a usability of grade control system 100 is improved, thereby increasing a likelihood that a machine is able to perform grading at a configured grade, which may reduce machine wear-and-tear, machine fuel usage, and/or the like relative to poorly maintaining a configured grade.

As indicated above, FIG. 1 is provided as an example. Other examples may differ from what is described with regard to FIG. 1.

Figure 2:
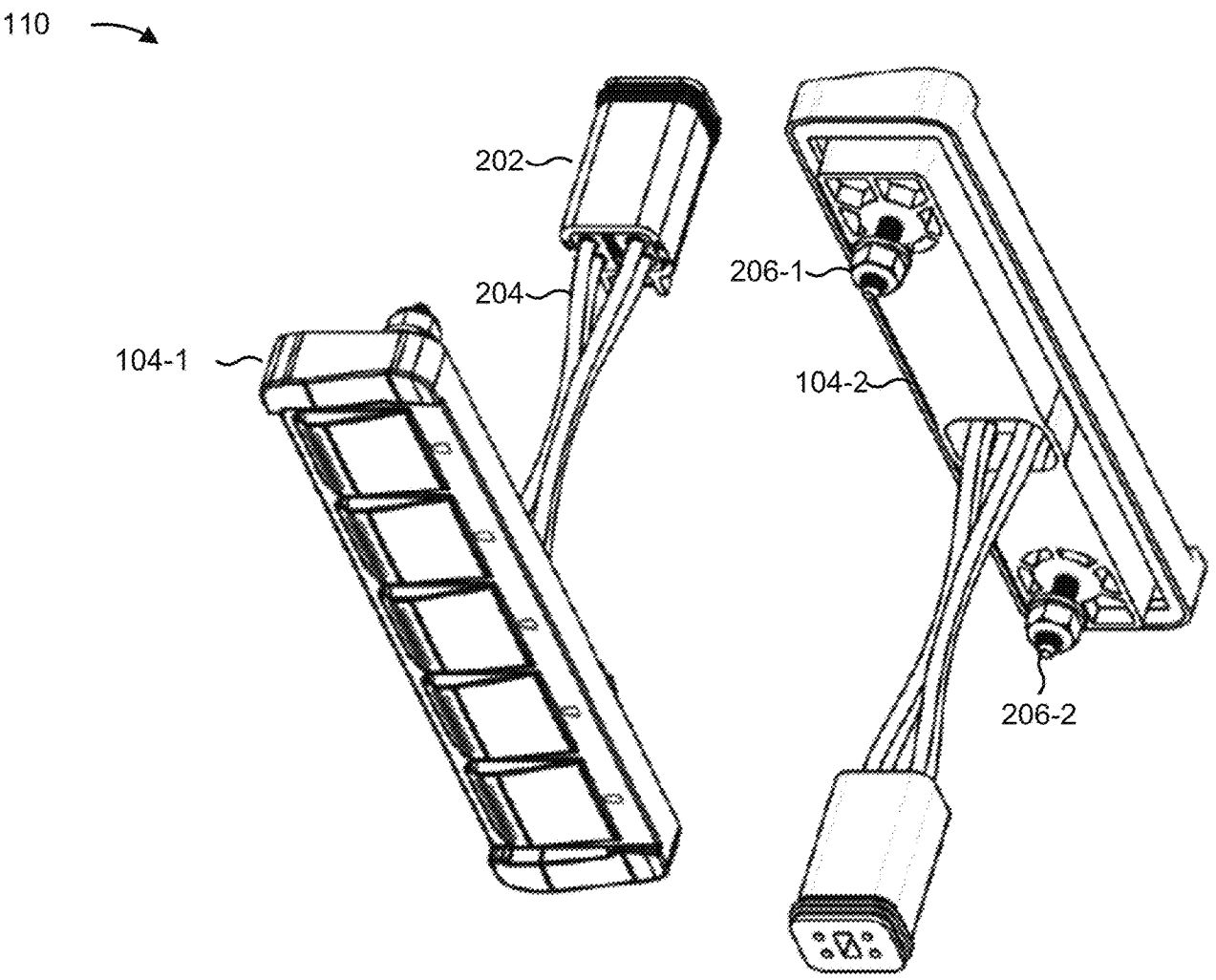
FIG. 2 is a diagram of an example grade control indicator assembly that may be included in the example grade control system of FIG. 1.

FIG. 2 is a diagram of an example grade control indicator assembly 110 that includes grade control indicator subassemblies 104. In this case, the grade control indicator subassemblies 104 are detached from a grade control system 100. As shown in FIG. 2, a grade control indicator subassembly 104 may include a plug 202 and a connector 204. In some implementations, the plug 202 and the connector 204 may enable the grade control indicator subassembly to be communicatively couplable to the grade control system 100. In another case, the plug 202 and the connector 204 may connect to input operator controls of a machine. The plug 202 may be a controller area network (CAN) bus interface pigtail type of connector or another bus interface type of connector that plugs into a machine harness to communicate with display 102 and/or a controller thereof. Alternatively, the plug 202 may be an Ethernet type of connector. Each grade control indicator subassembly 104 may include a set of attachment assemblies 206, shown as attachment assembly 206-1 and attachment assembly 206-2. The attachment assemblies 206 may include mounting studs, locking nuts, screws, washers, and/or the like. In this way, a grade control indicator subassembly 104 may be physically connected to and subsequently disconnected from the grade control system 100, an operator controls, and/or the like.

As indicated above, FIG. 2 is provided as an example. Other examples may differ from what is described with regard to FIG. 2.

Figure 3:
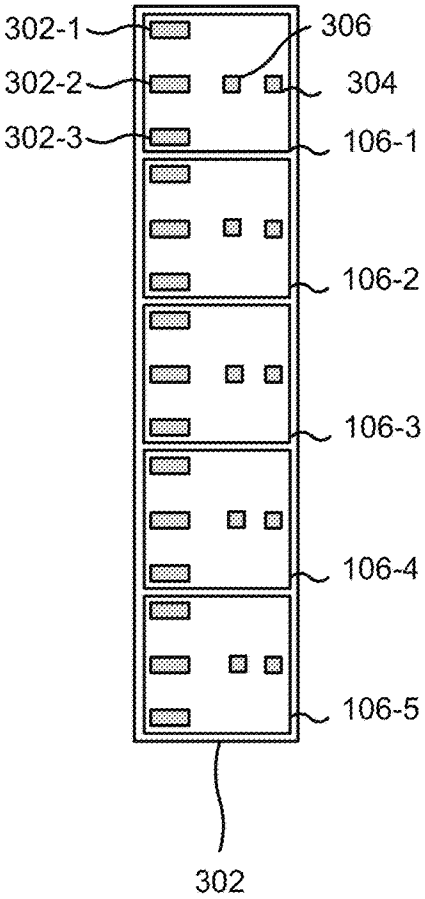
FIG. 3 is a diagram of example grade control indicator subassembly that may be included in the example grade control indicator assembly of FIG. 2.

FIG. 3 is a diagram of an example grade control indicator subassembly 104. As shown in FIG. 3, the grade control indicator subassembly 104 may include grade control light indicators 106-1 through 106-5. Each grade control light indicator 106 may include a set of light 302, shown as light 302-1 through 302-3, a light 304, and a light 306, which may each be light emitting diodes (LEDs) forming indicator bulbs for grade control light indicators 106.

The light 302 may be disposed behind a grade indicator 114 of a grade control light indicator 106. Grade indicator 114 may form a light bar that may be active (e.g., lit) when a controller determines that a grade of a machine corresponds to a position of grade indicator 114 with respect to other grade indicators 114. For example, a grade control light indicator 106 may include multiple light 302 to provide multiple levels of brightness for indicating a grade when lighting up the grade indicator 114. Alternatively, characteristics of the light 302 may be adjustable independently of a grade of a machine. For example, the brightness may be manually adjusted by an operator, automatically controlled based on an ambient light sensor or a timer, and/or the like.

Additionally, or alternatively, the light 302 and/or another light, such as a light 304 or a light 306 may be associated with multiple colors to provide information relating to a grade when lighting up grade indicator 114. For example, the light 302 or another light may be a red light, a green light, and a yellow light. As another example, the light 302 or another light may be one or more amber lights, one or more green lights, and/or the like. In this case, differing colors may correspond to differing statuses of functions controlled by the grade control light indicators 106. For example, a light of the button 106-3 may be green to indicate that a machine is on grade, whereas lights of buttons 106-1, 106-2, 106-4, and 106-5 may be amber or red to indicate that the machine is off grade.

A light 304 may be a function status indicator. For example, a light 304 may be communicatively coupled to a controller and the controller may cause the light 304 to be active when a corresponding function (e.g., a function of function indicator 112) is on. In this way, light 304 enables information to be provided regarding whether a function is active (e.g., actually being used). For example, when an automatic grade control function in off, a light 304 may be off to indicate that a function to use automatic grade control is off. Similarly, at another time when the automatic grade control is on, the light 304 may be on to indicate that the automatic grade control function is being used.

A light 306 may be a function availability indicator to illuminate function indicator 112. For example, a light 306 may be communicatively coupled to a controller and the controller may cause the light 306 to be active when a corresponding function (e.g., a function of function indicator 112) is available for use. In this case, when the function is unavailable (e.g., when automatic grade control is unavailable), light 306 may be off.

The lights 302, 304, and 306 may be coupled to a controller, a processor, a microprocessor, and/or the like, such as via the plug 202. In this way, the controller, the processor, the microprocessor, and/or the like may control a brightness, an illumination, and/or the like.

As indicated above, FIG. 3 is provided as an example. Other examples may differ from what is described with regard to FIG. 3.

Figure 4:
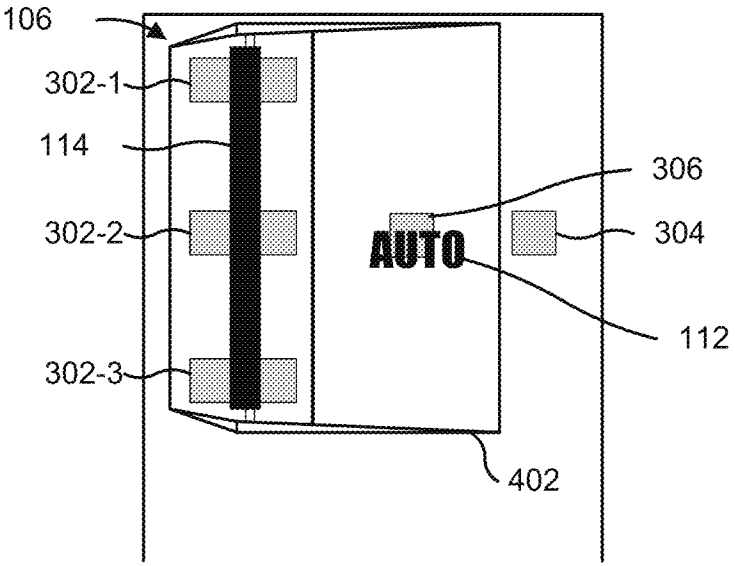
FIG. 4 is a diagram of an example grade control indicator that may be included in the example grade control indicator subassembly of FIG. 3.

FIG. 4 is a diagram of an example grade control light indicator 106. As shown in FIG. 4, the grade control light indicator 106 may include a function indicator 112 and a grade indicator 114. The function indicator 112 may be illuminated by light 306. Similarly, the grade indicator 114 may be illuminated by the light 302. The function indicator 112 and the grade indicator 114 may be clear-etched or white-etched into a surface of indicator frame 402, which may be a controllably illuminated button forming a portion of a keypad formed by a grade control indicator subassembly 104. A surface of the function indicator 112 and/or the grade indicator 114 may be silicon that is coated in an opaque coating, such as a black coating, and clear-etched to form a backlit, transparent area that forms an iconography for the function indicator 112 and/or the grade indicator 114. As a result, when the function indicator 112 and/or the grade indicator 114 is not illuminated, the iconography of the function indicator 112 and/or the grade indicator 114 may not be visible to an operator.

As indicated above, FIG. 4 is provided as an example. Other examples may differ from what is described with regard to FIG. 4.

INDUSTRIAL APPLICABILITY

A grade control indicator assembly may be used with any grade control system of any machine. The grade control indicator assembly may receive information identifying a grade of a machine, such as a grade that is being achieved by an implement of the machine with respect to a right side of the implement and with respect to a left side of the implement. The grade control indicator assembly may illuminate one or more grade control light indicators to identify the grade to an operator. The grade control indicator assembly may receive input via a user interaction with one or more buttons of a keypad, which may form the one or more grade control light indicators, thereby enabling operator control of the grade of the machine.

Several advantages may be associated with the grade control indicator assembly. For example, by providing grade control light indicators and keypad buttons for controlling a grade in a common assembly, the grade control indicator assembly improves a usability by operators of a machine. In this way, an accuracy of grade control may be improved. Moreover, based on decoupling the grade control indicator assembly from a display by providing the grade control indicator assembly as a separate assembly that is connectable to the display and does not include the display rather than integrated into the display, repairability may be improved. In this way, durability of a machine may be improved, costs associated with repairs to the grade control indicator assembly may be reduced, and/or the like.

Further, the grade control system may be decoupled from other operator controls of the machine, thereby improving repairability relative to the grade control system being integrated into operator controls of a machine. As another advantage, surfaces of the grade control light indicators may be raised relative to the grade control system and a display or a frame thereof, thereby providing a threshold increased viewing angle of the grade control light indicators. This may enable an operator to view the grade control light indicators at a greater range of positions within an operator station of the machine, thereby improving grade control.

What is claimed is:

1. A grade control indicator assembly, comprising:

a keypad to control one or more functionalities of a machine, the keypad including first grade control indicator subassembly and a second grade control indicator subassembly, the first grade control indicator subassembly including a first subset of grade control light indicators for indicating a grade of the machine with respect to a first side of the machine, and the second grade control indicator subassembly including a second subset of grade control light indicators for indicating the grade of the machine with respect to a second side of the machine.

2. The grade control indicator assembly of claim 1, wherein the keypad includes one or more buttons to adjust the grade of the machine.

3. The grade control indicator assembly of claim 1, wherein the keypad includes one or more buttons to adjust at least one of:

a locking functionality, a memory functionality, a display functionality, or an automatic grade control functionality.

4. The grade control indicator assembly of claim 1, wherein a characteristic of the first subset of grade control light indicators is adjustable independent of the grade of the machine.

5. The grade control indicator assembly of claim 1, wherein the first subset of grade control light indicators includes a grade control light indicator, and wherein the grade control light indicator includes a plurality of indicator bulbs associated with a plurality of colors.

6. The grade control indicator assembly of claim 1, wherein the first subset of grade control light indicators and the second subset of grade control light indicators are raised above a frame of the keypad to provide greater than a threshold viewing angle.

7. The grade control indicator assembly of claim 1, wherein the keypad is configured to attach to and detach from a display.

8. The grade control indicator assembly of claim 7, wherein the keypad is communicatively couplable to the display to provide information relating to a user interaction with the keypad or the grade of the machine.

9. A grade control system, comprising:

a display device; and a grade control indicator assembly, the grade control indicator assembly including a first sub-assembly disposed on a first side of the display device and associated with indicating a grade of a machine with respect to a first corresponding side of the machine, and the grade control indicator assembly including a second sub-assembly disposed on a second side of the display device and associated with indicating the grade of the machine with respect to a second corresponding side of the machine, each sub-assembly including a plurality of grade control light indicators raised above a frame of the grade control indicator assembly.

10. The grade control system of claim 9, wherein the grade control indicator assembly is decouplable from the display device.

11. The grade control system of claim 9, wherein the plurality of grade control light indicators of each sub-assembly is associated with a viewing angle, relative to a normal plane perpendicular to a surface of the plurality of grade control light indicators, of greater than or equal to at least one of:

15 degrees, 30 degrees, 45 degrees, 60 degrees, 75 degrees, 90 degrees.

12. The grade control system of claim 9, wherein the plurality of grade control light indicators forms a portion of a keypad for the display device.

13. The grade control system of claim 9, further comprising:

a bus interface.

14. The grade control system of claim 9, wherein the plurality of grade control light indicators are associated with an adjustable brightness.

15. A grade control indicator assembly, comprising:

a keypad to control one or more functionalities of a machine, the keypad including a set of grade control indicator subassemblies that include a set of grade control light indicators integrated into the keypad and raised above a surface of the keypad to provide greater than a threshold viewing angle, and the set of grade control light indicators including a first subset of grade control light indicators for indicating a grade of the machine with respect to a first side of the machine and a second subset of grade control light indicators for indicating the grade of the machine with respect to a second side of the machine.

16. The grade control indicator assembly of claim 15, wherein the set of grade control light indicators are buttons of the keypad.

17. The grade control indicator assembly of claim 15, wherein the set of grade control light indicators are clear-etched or white-etched.

18. The grade control indicator assembly of claim 15, wherein the set of grade control light indicators are controllably illuminated buttons.

19. The grade control indicator assembly of claim 15, wherein the set of grade control light indicators are backlit buttons.

20. The grade control indicator assembly of claim 15, wherein the grade control indicator assembly does not include a display.

* * * * *